US005567556A

United States Patent [19]

Yano et al.

[11] Patent Number: 5,567,556

[45] Date of Patent: Oct. 22, 1996

[54] ELECTROPHOTOGRAPHIC PROCESS AND APPARATUS SIMULTANEOUSLY EFFECTING IMAGE EXPOSURE AND DEVELOPING STEPS TO OPPOSITES SIDES OF PHOTOSENSITIVE MEMBER

[75] Inventors: Hideyuki Yano; Junji Araya; Osamu Iwasaki, all of Yokohama, Japan

[73] Assignee: Canon Kabushiki Kaisha, Tokyo, Japan

[21] Appl. No.: 258,495

[22] Filed: Jun. 10, 1994

[30] Foreign Application Priority Data

Jun. 11, 1993 [JP] Japan ..... 5-140685

[51] Int. Cl.[6] ..... G03G 15/00

[52] U.S. Cl. ..... 430/55; 430/122

[58] Field of Search ..... 430/55, 102, 103, 430/122

[56] References Cited

FOREIGN PATENT DOCUMENTS

| | | |
|---|---|---|
| 0488151 | 6/1992 | European Pat. Off. . |
| 0606004 | 7/1994 | European Pat. Off. . |
| 4133767 | 5/1992 | Germany . |
| 58-98746 | 6/1983 | Japan . |
| 60-22145 | 2/1985 | Japan . |

OTHER PUBLICATIONS

Patent Abstracts of Japan, vol. 9, No. 141, CP–364), June 15, 1985 for JP60–22145 (JP 60–22145 is already of record).

*Primary Examiner*—Kathleen Duda

*Attorney, Agent, or Firm*—Fitzpatrick, Cella, Harper & Scinto

[57] ABSTRACT

An electrophotographic process in which image information exposure step and a developing step are substantially simultaneously carried out to opposite sides of a photosensitive member includes preparing an electrophotographic photosensitive member having a conductive base layer transmitting light and a photosensitive layer thereon; exposing the conductive base side of the photosensitive member to light information; rubbing an opposite side of the photosensitive member with a developer supplied with a developing bias voltage of the same polarity as the polarity of the developer in a region including an upstream side end a downstream side of an image exposure region of the photosensitive member; wherein an absolute value of a sum of a triboelectric charge potential provided on a surface of the photosensitive member by rubbing between the developer and the photosensitive member, and a surface potential of the photosensitive member provided by application of the developing bias upstream of the image exposure region, is larger than an absolute value of the developing bias.

20 Claims, 5 Drawing Sheets

ELECTROPHOTOGRAPHIC PROCESS AND APPARATUS SIMULTANEOUSLY EFFECTING IMAGE EXPOSURE AND DEVELOPING STEPS TO OPPOSITES SIDES OF PHOTOSENSITIVE MEMBER

FIELD OF THE INVENTION AND RELATED ART

The present invention relates to an electrophotographic process and apparatus simultaneously effecting image exposure and developing steps to opposite sides of a photosensitive member.

As for a copying apparatus or a recording apparatus for providing hard copies from a computer, an electrophotographic process is widely used. In an electrophotographic process, charging, exposure and developing steps are effected on a photosensitive member sequentially, and an image visualized by toner is transferred Onto a transfer sheet, and the toner image is fixed thereon into a final output record. The printed image thus provided is advantageous in high resolution and high contrast and therefore high image quality, over thermal transfer type, ink jet type and an impact printing type as other hard copy producing means.

However, a large number of steps are required to form an image, and therefore, a circumferential length of the photosensitive member which is movable along an endless path is not easily downsized with the result of high cost and complicated structure.

In view of the above, there are some methods in which the charging, exposing, and developing operations and so on are simultaneously carried out substantially at the same position using electrophotographic process. Typical examples thereof are Japanese Laid-Open Patent Application Nos. 98746/1983 and 22145/1985.

Generally, in The prior art of this type, electroconductive toner or a mixture of electroconductive carrier and insulative toner, is used, and a series of process operations including (1) removal of residual toner remaining after previous image formation, (2) contact charging, (3) image exposure from a back side of the photosensitive member and (4) contact development, are substantially simultaneously carried out. More particularly, these process operations are all carried out in a contact nip provided by a magnetic brush roller contacted to a front surface of the photosensitive member at a position corresponding to a back side image exposure position.

More particularly, as shown in FIG. 3, the cleaning operation is effected by removing residual toner at a position upstream of the contact nip 6, where a magnetic brush forms chains on a rotating developing sleeve 2. At this time, the toner used is magnetic toner. Since a magnet roll is disposed in the sleeve, the cleaning effect can be enhanced by the magnetic force provided thereby.

Subsequently, the surface of the photosensitive member is rubbed by electroconductive magnetic brush (conductive toner or conductive carrier), by which electric charge is injected, thus charging the surface of the photosensitive member. Here, the electric charge is trapped at the impurity level adjacent the surface of the photosensitive member, and therefore, the charging member has a sufficiently low resistance, and a longer charging time is required. This requires that the material of the photosensitive member can retain the electric charge adjacent the surface. Under the circumstances, amorphous silicon (a-Si) or OPC photosensitive member or the like having a surface prohibition layer is used. Simultaneously with this step, an image is projected to the backside of the photosensitive member. The light source is in-the form of an LED array 4 or the like. The image is projected to a predetermined position of the photosensitive member in the nip 6 formed between the developing sleeve and the photosensitive member. After formation of an electrostatic latent image by the image exposure, the developing operation is carried out simultaneously with the electrostatic latent image formation or in the rest of the developing nip.

When electroconductive toner is used for the magnetic brush, the electric charge electrostatically induced by the latent image on the photosensitive member is concentrated to the toner adjacent the ends of the chains through the toner chain, and the toner is removed from the chain by coulomb force between the electric charge and the latent image charge, thus developing the latent image.

When a two component developer is used for the magnetic brush with the similar structure, and therefore, the development is effected by the magnetic electroconductive carrier and the insulative toner, the chains of the conductive carrier function as an adjacent electrode, and therefore, an electric field sufficient for the development can be formed even if the voltage applied between the photosensitive member and the developing sleeve is low. Accordingly, low voltage is enough to effect the development with insulative toner.

Generally, image transfer using electric field is difficult in the case of the electroconductive toner, and the two component developer using the insulative toner is preferable.

However, in the simplified process, a large number of process operations including charging, exposure, development and cleaning, are carried out in the nip formed between the photosensitive member and the developing sleeve, and therefore, additional problems arise.

As a representative one of them, the charging voltage for effecting charging and development is lower than a developing bias voltage. In such a process, the development is necessarily reverse-development. A reverse contrast provided by supplying individually the charging potential and the developing potential in the conventional electrophotographic process, is not applicable to the simplified process. Additionally, slight improper charging occurs due to (1) the dark decay of the photosensitive member during the period the member moves from the charging position to the developing position, (2) the voltage drop at the ends of the magnetic brush because of the electric resistance value of the magnetic brush itself, and/or (3) incomplete electric charge injection into the photosensitive member. For this reason, the surface potential of the photosensitive member charged is slightly lower than the voltage applied to the magnetic brush. If this occurs, a sufficient density image formation is not performed.

As a result, actually, in the developing position, a slight degree of developing contrast is produced in the non-image area, as shown in FIG. 4, with the result of fog (deposition of toner on the background of the image) to a non-negligible extent.

SUMMARY OF THE INVENTION

Accordingly, it is a principal object of the present invention to provide a process and apparatus by which high quality images can be produced.

According to an aspect of the present invention, there is provided an electrophotographic process in which image information exposure step and a developing step are substantially simultaneously carried out to opposite sides of a photosensitive member, comprising: preparing an electrophotographic photosensitive member having a conductive base layer transmitting light and a photosensitive layer thereon; exposing the conductive base side of the photosensitive member to light information; rubbing an opposite side of the photosensitive member with a developer supplied with a developing bias voltage of the same polarity as the polarity of the developer in a region including an upstream side and a downstream side of an image exposure region of the photosensitive member; wherein an absolute value of a sum of a triboelectric charge potential provided on a surface of the photosensitive member by rubbing between the developer and the photosensitive member, and a surface potential of the photosensitive member provided by application of the developing bias upstream of the image exposure region, is larger than an absolute value of the developing hies.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

EMBODIMENT 1

Figure 3:
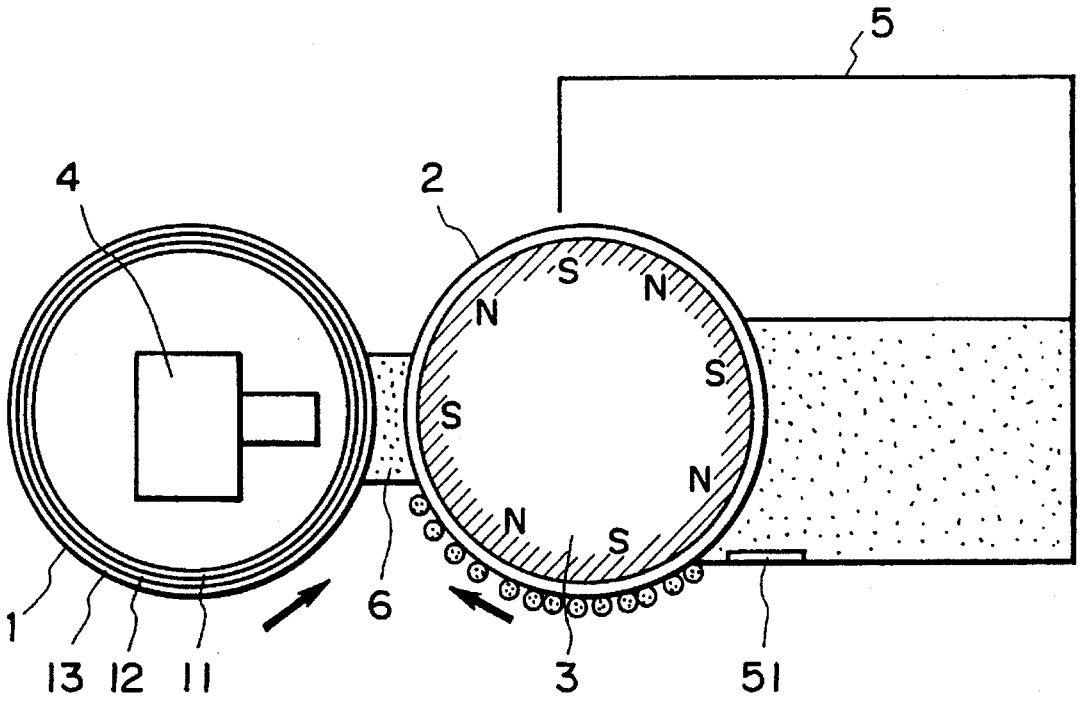
FIG. 3 illustrates an apparatus in which simultaneous back side exposure, cleaning, charging and developing processes are carried out substantially simultaneously (simplified process).
Figure 4:
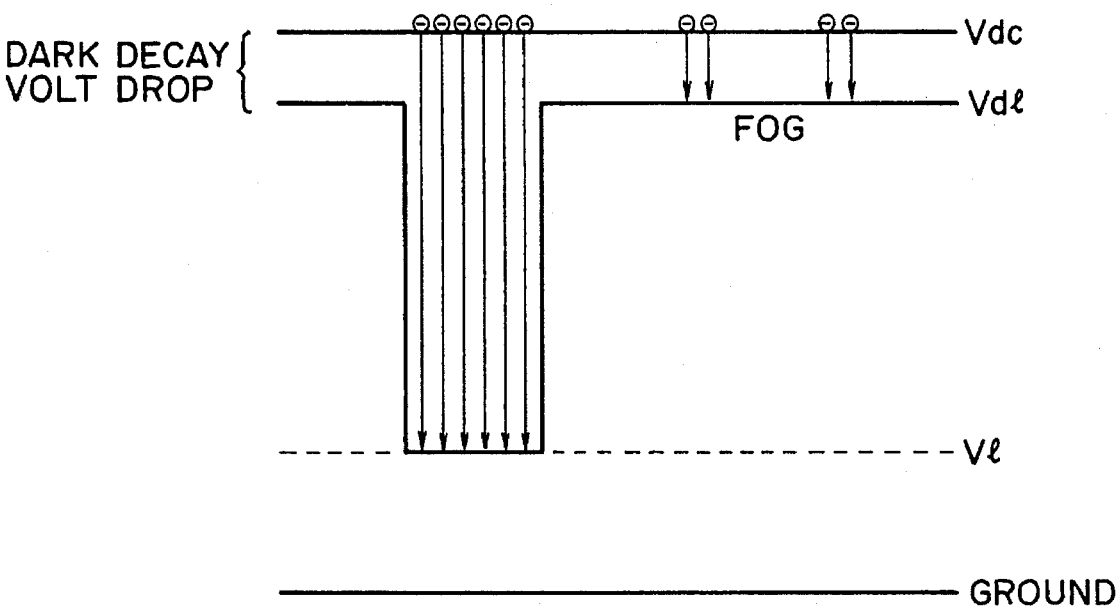
FIG. 4 shows a relation between a surface potential of a photosensitive member and a developing sleeve potential in a conventional simplified process.
Figure 5:
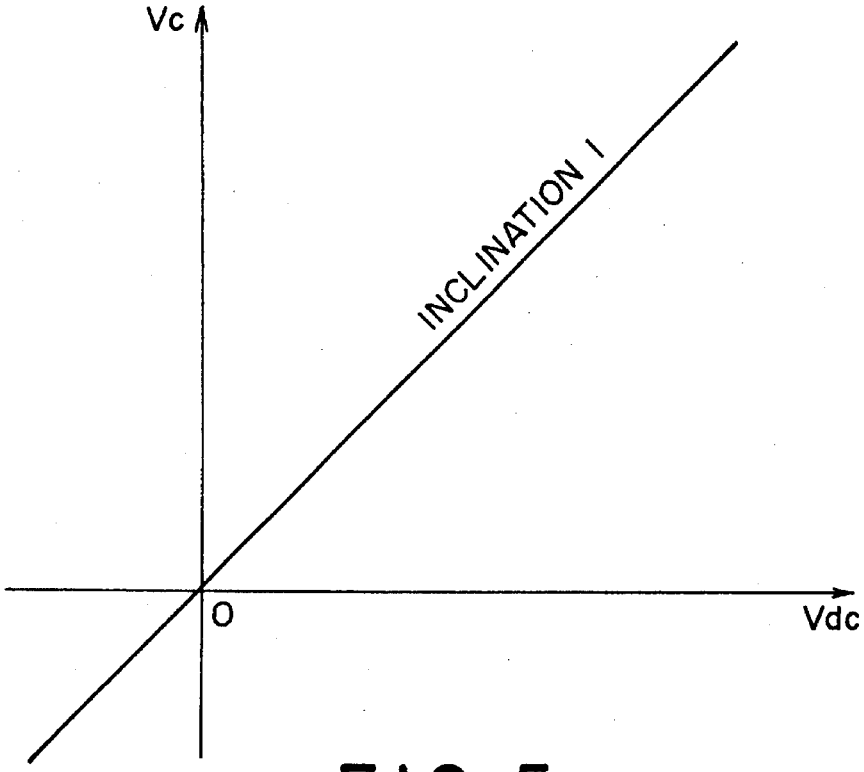
FIG. 5 shows a charge potential in the simplified process.

As shown in FIG. 3, in this embodiment, in the simultaneous process (simplified process) in which image exposure to the backside of the photosensitive member (opposite from the side to which the developer is supplied), the cleaning, the charging and the developing are substantially simultaneously carried out, the photosensitive member comprises a function separation type OPC photosensitive member of negative charging property, and the material of the carrier (developer) and the material of the photosensitive member surface are selected so as to provide a negative polarity offset potential.

The description will be made first as to the electrophotographic apparatus used in FIG. 3 embodiment. The photosensitive member I comprises a transparent glass cylinder 11 having a diameter of 30 mm and a thickness of 1.5 mm, and a photosensitive layer 13 thereon. The material of the cylinder is not limited to the glass, but may be a resin material which is transparent and the stability of the dimensional accuracy is satisfactory. Examples are polycarbonate resin or PMMA resin materials.

On the cylinder 11, ITO layer 12 is applied into a thickness of 1 μm as a transparent conductive layer. A photosensitive layer thereon will be described.

A blocking layer (UCL having a thickness of approx. 10 μm and an intermediate resistance) for blocking injection of positive charge from the conductive layer, charge generating layer (CGL having a film thickness of approx. 1 μm and comprising polyvinylbutyral resin binder and disazo pigment), p-type charge transfer layer (CTL having a thickness of approx. 20 μm and comprising acrylic resin binder and hydrazone), are laminated in the order named from the bottom (cylinder 11 side), thus constituting a normal OPC photosensitive member of function separation type.

The acrylic resin is used as the binder in the CTL in order to provide the negative offset voltage in combination with the carrier in the developer, as will be described hereinafter.

A developing unit will be described.

The developing unit comprises non-magnetic sleeve 2 of stainless steel or aluminum which has a diameter of 30 mm and which is rotatable, and a stationary magnet 3 therein. The sleeve rotates in the same peripheral movement direction at a speed six times that of the photosensitive member.

In this embodiment, the process speed is determined by the peripheral speed of the photosensitive drum, and is 50 mm/sec in this embodiment, and therefore, the peripheral speed of the sleeve is 300 mm/sec. The magnetic pole distribution of the magnet roll comprises 8 magnetic poles having alternating polarities and having the same magnetic forces. The magnet is so disposed that a peak position of one of the poles is on a line connecting the centers of the photosensitive drum and the developing sleeve. The magnetic flux density on %he sleeve at the peak position is 800 Gauss.

The developer is a two component developer comprising magnetic electroconductive carrier and magnetic insulative toner. The magnetic conductive carrier is contributable to the cleaning of the toner, that is, removal of the residual toner remaining on the photosensitive member after the image transfer, to charging of the surface of the photosensitive member, to the conveyance of the toner, and to generation of off-set potential which is related with the present invention. The particle size is 20 μm, and the volume resistivity is $10^5$ ohm.cm. It is a resin carrier comprising phenol resin material, magnetite and carbon black (for the purpose of electroconductivity). The volume resistivity is determined on the basis of an electric current flowing through the carrier packed in a container having a bottom area of 3 $cm^2$ and a height of 5 mm with 1 kg, when 10 V is applied.

As a result of investigations, it has been confirmed that in order to provide an offset potential which is high in the negative direction, it is desirable that the resin carrier particles are coated, by plating, with nickel zinc or the like having an electroconductivity and having a proper work function (energy required for discharging free electrons from the metal surface and is an index of the potential generated by triboelectricity). The magnetic insulative toner is a negative toner which is chargeable to the negative polarity and has a particle size of 7 μm and a resistivity of $10^{14}$ ohm.cm.

The toner particles and carrier particles are mixed at T/D ratio of 15% (weight ratio of toner relative to the entire developer). The mixture is supplied into the developing device 5. In the developing device, a metal blade 51 is opposed to the developing sleeve to regulate the thickness of the developer layer into approx. 1 mm. The space between the developing sleeve and the photosensitive drum is maintained at 0.5 mm by an unshown abutment rollers at the opposite ends of the sleeve. When the photosensitive drum and the developing sleeve are rotated at the predetermined speeds with this state, the nip therebetween as a space of approx. 7 mm.

The voltage applied between the developing sleeve and the photosensitive drum and therefore between the developer and the photosensitive drum is −300 V, and therefore, reverse-development is carried out in combination with the negative toner particles.

The exposure unit comprises a conventional LED head, which is inserted into the photosensitive drum to effect the backside image exposure at a position across the thickness of the photosensitive drum from the developing unit. The image exposure position is 2 mm from the downstream end of the nip with respect to the rotational direction of the developer. If the exposure position is deviated too much to the upstream side in the nip, the latent image formed by the exposure is recharged by the conductive carrier with the result of smaller latent image contrast, and therefore, of the reduction of the image density. On the contrary, if it is deviated to the downstream side too much, the region in which the development is effected is too short with the result of reduction of the image density.

Example of image formation with the use of the above-described apparatus will be described.

Upstream of the nip formed between the photosensitive member and the developer on the developing sleeve, the residual toner remaining on the photosensitive member in the previous image forming operation is removed by the rotating magnetic brush (cleaning). Simultaneously therewith, by the contact between the conductive carrier and the photosensitive member, the electric charge is injected to a trap level of the surface of the photosensitive member, thus charging it. Actually, however, it is difficult to charge the surface of the photosensitive member to the same potential as that applied, because of the dark decay, incomplete charging efficiency, voltage drop due to the resistance of the magnetic brush. In this embodiment, it has been confirmed that when the applied bias voltage is changed by 300 V, the surface potential of the photosensitive member is charged only to 295 V.

However, a potential, so-called offset potential, can be provided in addition to the potential provided by the application of the voltage to the developing sleeve, by proper selection of the material of the surface of the photosensitive member and the material of the developer.

Figure 6:
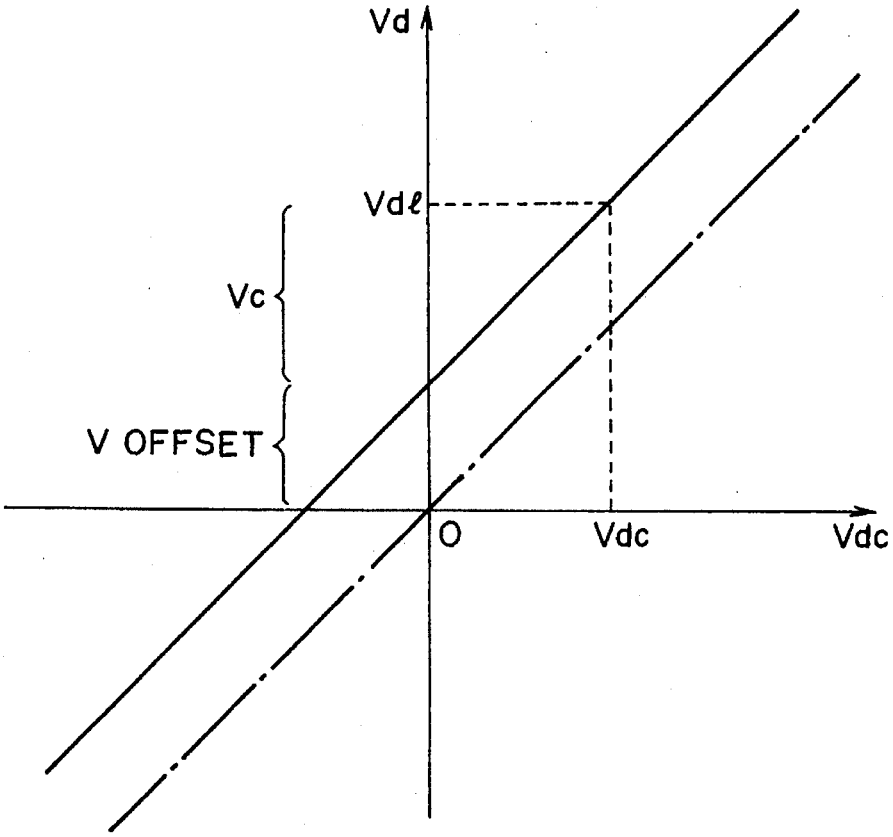
FIG. 6 illustrates a charge potential in this invention.

This is a potential provided by a kind of triboelectricity produced by the rubbing between the developer and the surface of the photosensitive member. Actually when a two component developer, the effect is of the rubbing with the carrier is significant. However, a similar effect can be provided oven if an additional component or components are used or even when one component developer is used. The potential due to the triboelectricity is observed even when 0 V is applied to the developing sleeve. When the voltage is increased, the voltage by the triboelectricity is added always as shown in FIG. 6.

Accordingly, when the use is made of the photosensitive member of the negative property, a combination of the materials of the surface of the photosensitive member and the developer is selected so as to produce the negative offset potential, and when the photosensitive member is of the positive property, the combination of the materials is so selected as to provide the positive offset potential. By doing so, a reverse contrast can be formed in the developing zone, and therefore, the fog arising from deposition of the toner on the non-image area (background), of the toner charged to the normal properly, can be avoided.

In this case, there is a possibility that the reversely charged toner having the opposite triboelectric polarity is deposited on the non-image area. However, it is possible to prevent the reverse toner from transferring to the transfer material by applying a voltage of a predetermined polarity to the transfer material.

Figure 7:
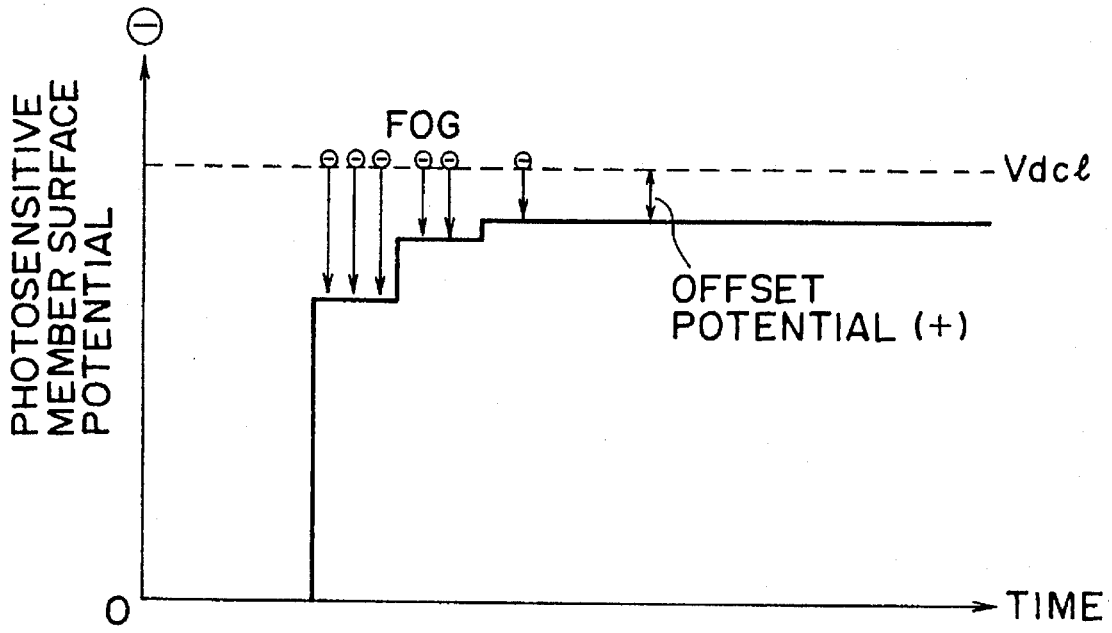
FIG. 7 shows change of charge potential in the simplified process, in comparison with the present invention.
Figure 8:
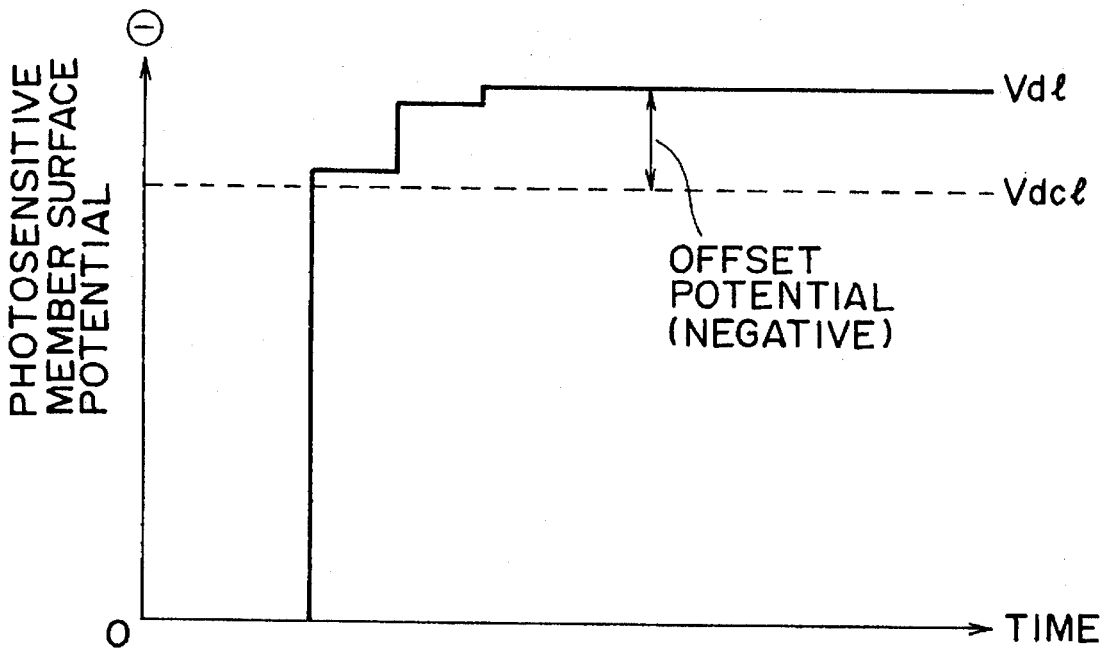
FIG. 8 shows change, with time, of the charge potential in the simplified process.

As shown in FIG. 7, when a photosensitive member having a poor charge retentivity at a high potential or a developer having a poor charging power for a high potential, is used, the charging is not sufficient by only one passing of tile photosensitive member through the charging position, and therefore, improper charging occurs for several rotations of the photosensitive member after start of the charging with the result of production of foggy background. However, when the offset potential has the same polarity as that of the voltage applied to the developing sleeve, the insufficiency of the charging can be compensated by the offset potential, as shown in FIG. 8. Therefore, upon the start of the image formation, the foggy background production even in the first several rotations of the photosensitive drum can be prevented.

In order to provide the toner offset potential of the desired polarity and of the desired height, the material of the surface of the photosensitive member and the material of the carrier are properly selected. The selection may be made in the light of the work function, however, it is preferable that experiments are carried out for the selection because the material added, surface configuration, the ambience, the property of the toner or the like are influential. In this embodiment, the binder of the CTL of the surface of the photosensitive member is polycarbonate resin material and acrylic resin material. On the other hand, the carrier comprises resin material in which magnetite is dispersed as the magnetic material, and the binder is phenol resin or polyester resin. Table 1 shows the result of measurements of the offset potentials. The measurements are effected as follows. Only carrier is supplied in the developing device of FIG. 3, and the drum and the developing sleeve are rotated through predetermined numbers with the applied bias voltage is 0 V, and the surface potential of the drum after passing through the nip is measured.

TABLE 1

| | Carrier | |
|---|---|---|
| CTL binder | Phenol resin | Polyethylene resin |
| Polycarbonate resin | +15 V | +20 V |
| Acrylic resin | −20 V | −10 V |

As will be understood, when the binder of the CTL is acrylic resin, and the binder of the carrier is phenol resin, the offset potential is −20 V, so that the offset voltage required when the negative property OPC is used. The experiments have been carried out with this combination.

In this embodiment, in order to provide sufficient image density, a DC voltage of −300 V is applied to the developing sleeve. Initially, the photosensitive member is simply rotated without the image exposure with 0 V applied to the developing sleeve (Vdc) (pre-rotation). Then, the surface potential Voffset of the photosensitive member was −20 V. This is the offset potential described hereinbefore. Then, Vdc=−300 V was applied. Then, the surface potential Vdl of the photosensitive member was −315 V, which was equal to −295 V provided by the applied voltage plus offset potential of −20 V.

In this state, the surface potential of the photosensitive member Vdl=−315 V, and the developing sleeve voltage Vdc is −300 V, and therefore, the regular toner charged to the negative polarity is prevented from being deposited on the non-image portion by the reverse contrast of 15 V, and therefore, no foggy background is produced.

In the exposure position in the later part in the nip with respect to the rotational direction of the developer in the nip, the light portion potential is lowered to −50 V by the image exposure using LED at the inside of the photosensitive member. In the nip formed by the developer after the image exposure position, the contact development under the application of the electric field is carried out. In this embodiment, the dark potential is −315 V, and the light potential is −50 V, and therefore, the development contrast is 265 V. Additionally, the conductive carrier chain is long enough to reach almost to the photosensitive member, and therefore, the electric field to the toner is very large, thus increasing the image density. The actually developed images had the density (reflection density) of approx. 1.5. Therefore, high density and high resolution images can be produced. The toner image thus provided is transferred onto a transfer sheet 6 by transfer roller 5. The resistance of the transfer roller used in this embodiment is $5\times10^8$ ohm (measured when it is press-contacted to an aluminum drum, and DC voltage of 2.0 KV is applied), and the applied bias voltage is +2 KV. The toner not transferred in the transfer position is removed from the surface of the photosensitive drum upstream of the nip during the next image formation, and therefore, does not influence the next image formation.

The comparison has been made with respect to the conventional simplified process. In the comparison example, the binder for the CTL of the photosensitive drum was polycarbonate resin, and the other structures thereof are the same as described in the foregoing.

As shown in Table 1, the offset voltage produced by the rubbing between the CTL comprising the polycarbonate resin binder and the carrier comprising the phenol resin binder, is +15 V, and therefore, it has the positive polarity which is opposite from the negative polarity which is the charging property of the photosensitive member.

Figure 1:
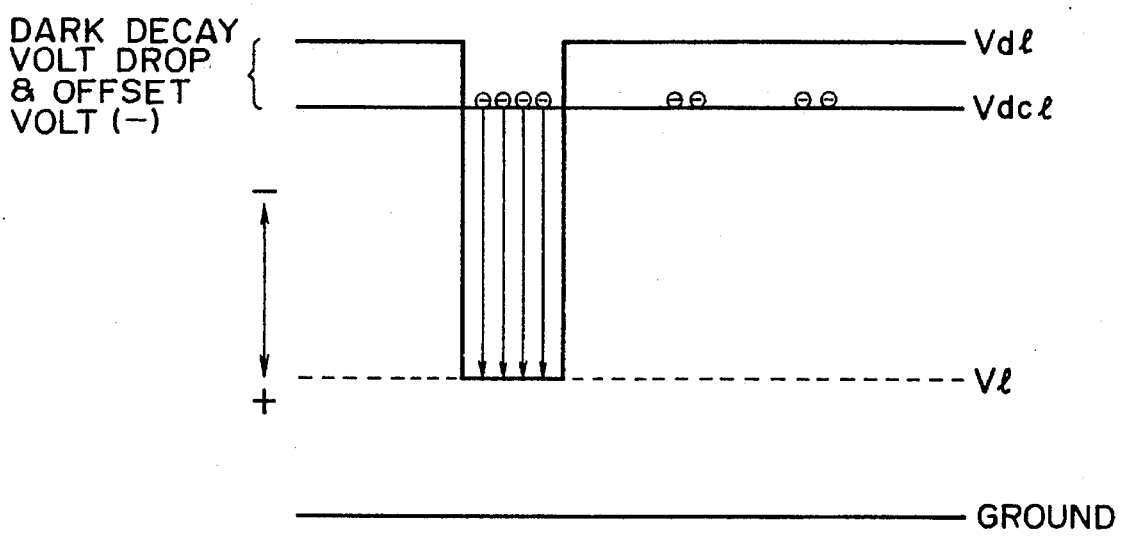
FIG. 1 illustrates a relationship between a surface potential of the photosensitive member and a potential of the developing sleeve, according to an embodiment of the present invention.
Figure 2:
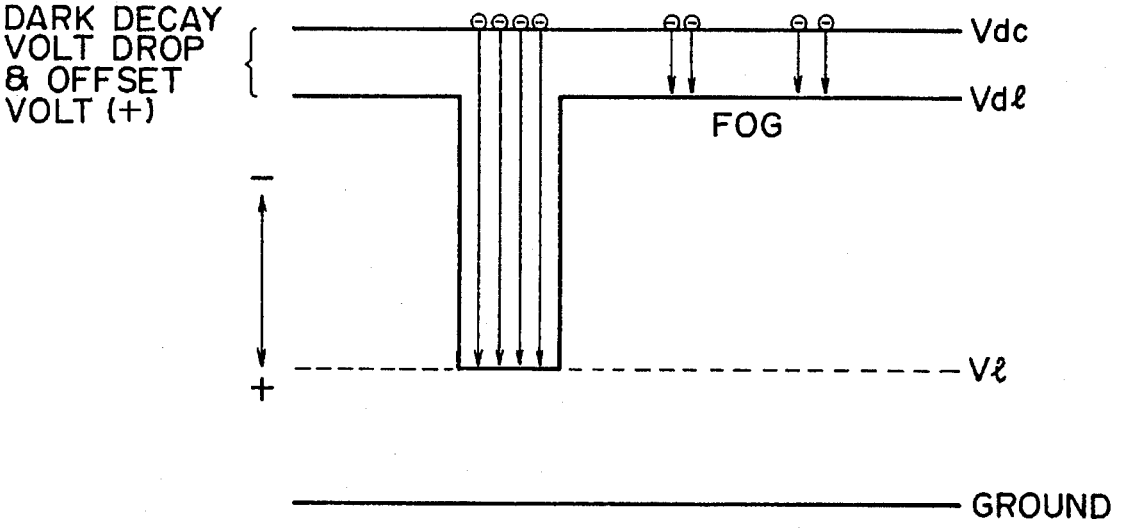
FIG. 2 illustrates comparison with the present invention in relation to the surface potential of the photosensitive member and the developing sleeve potential.

With this structure, as shown in FIG. 2, the absolute value of the development potential is larger than the absolute value of the charged potential with the result of formation of electric field effective to deposit the toner from the surface of the developing sleeve to the non-image area of the photosensitive drum.

More particularly, when the rotation is carried out after 0 V is applied to the developing sleeve, the surface potential of the photosensitive member was +15 V due to the offset potential. Then, when the developing sleeve is supplied with −300 V, −280 V results on the surface of the photosensitive member, which was the sum of −295 V provided by the charge injection and +15 V provided by the offset potential. On the other hand, the voltage applied to the magnetic brush at the developing position is −300 V with the result of developing direction contrast of 20 V for the non-image area, and therefore, the potential relationship shown in FIG. 2 results. Then, the foggy background is produced. Since the fog is produced by the regularly charged toner, the toner is transferred onto the transfer sheet, with the result of as large as 5% fog in reflection ratio. Therefore, the image quality is remarkably decreased.

The offset potential resulting from the rubbing between the CTL using the acrylic binder and the carrier using the phenol resin is −20 V, as described hereinbefore. With this potential, no fog occurs in the non-image area on the photosensitive member. A slight degree of the fog provided by reversely charged toner is prevented from transferring onto the transfer sheet by application of a positive bias voltage in the transfer position. By this, the fog reflection ratio on the transfer sheet was 0.3% approx.

As described in the foregoing, by selecting the proper combination of the material of the CTL of the surface of the photosensitive member and the material of the carrier, the reverse contrast can be provided, so that high quality image with little background fog can be produced.

EMBODIMENT 2

In this embodiment, the photosensitive member of Embodiment 1 is used with modification that the charge generating layer CGL and the charge transfer layer CTL are reversed in the laminated structure and that an additional charge injection layer is provided on the surface of the photosensitive member, by which a photosensitive member suitable for the positive charging is provided despite p-photo-semiconductor. In addition, the materials of the charge injection layer and the carrier of the developer are properly selected to provide the positive polarity offset potential.

The charge injection layer of this embodiment is provided by dispersing electroconductive particles in the insulative resin. An equivalent capacity constituted by the photosensitive layer (dielectric layer) and the conductive particles (fine floating electrodes), is constituted, and the electric charge is injected thereinto by the conductive magnetic brush to electrically charge it.

In the conventional photosensitive member, when the photosensitive material is dispersed in the binder, improper dispersion occurs unless affinity therebetween is good, with the result of deteriorated property of the photosensitive member. For this reason, the usable binder is limited very much. However, by the provision of the charge injection layer at the surface, the affinity between the charge transfer material and the binder need not be considered. Therefore, the range of the usable binder selection for providing the proper polarity and proper level offset potential, is significantly widened depending on the material of the photosensitive member, the number of trap levels for trapping the charge on the surface of the photosensitive member is small, and therefore, the charge injection property is poor. For this reason, improper charging occurs unless the developer has sufficiently low resistance, but by the provision of the charge injection layer, the conductive particles in the charge injection layer can be charged, and therefore, high efficiency charging is possible. Actually, if the charge injection layer of this invention is provided on the surface of the conventional OPC photosensitive member, the surface of the photosensitive member can be instantaneously charged even with a high resistance magnetic brush (approx. $10^8$ ohm). Additionally, the durability voltage of the charge injection layer is so high that several hundred volts can be applied to the conductive magnetic brush, by which sufficient image density can be provided with the high development contrast.

In order to produce the photosensitive member suitable for the positive charging using p-type photo-semiconductor, the order of lamination is reversed (CGL, CTL from the bottom layer). When the CGL is formed on the surface, it has been required that a surface protection layer is provided because the material of CGL itself is fragile. However, according to this invention, the charge injection layer also functions as a surface protection layer, and therefore, there is no need of additional protection layer. For this reason, the photosensitive member suitable for the positive charging can be easily manufactured.

In this embodiment, electroconductive fine particles are dispersed in insulative binder in OCL. Typical conductive fine particles are $SnO_2$ fine particles having a reduced resistance by doping with antimony. The $SnO_2$ particles have a small particle size such as 0.3 μm or lower, and therefore, are suitable for the fine floating electrodes. Other usable materials include ITO, $TiO_2$, TiO, ZnO, ZrO or another metal oxide, conductive carbon, Al, Cu or other metal particles. The fine capacitors having the floating electrodes, are rubbed with the conductive magnetic brush supplied with the voltage, so that they are charged.

When the resistance of the surface of the photosensitive member is low, the pattern of the latent image formed on the photosensitive member surface flows (image flow). In order to prevent this and also to prevent improper charging, 2–120% by weight of $SnO_2$ is dispersed in the entirety of the OCL, preferably. In this embodiment, 70% by weight was added (weight of conductive filler/total weight of conductive filler and the resin binder).

In order to provide the reverse contrast by the offset potential using the photosensitive member suitable for the positive charging., the combination of the materials of the photosensitive member and the developer is properly selected in consideration of the triboelectric charge series so as to provide the positive polarity offset potential.

In this embodiment, the binder is polycarbonate resin, polyester resin or polyethylene terephthalate resin and the resin carrier binder was phenol resin or polyethylene resin. The result of measurements are given Table 2 below.

TABLE 2

| | Carrier | |
|---|---|---|
| CTL binder | Phenol resin | Polyethylene resin |
| Acrylic resin | −20 V | −10 V |
| Polycarbonate resin | +15 V | +20 V |
| Styrene acrylic resin | +15 V | +10 V |

From the above, proper offset potential of +20 V can be provided by polycarbonate resin as the binder of the OCL and polyethylene resin as the binder of the carrier.

Results of actual experiments will be described.

The apparatus is exactly the same as that used in the first embodiment with the exception that the photosensitive member and the toner are changed.

In the first embodiment, the negative property toner was used. In this embodiment, the toner of positive property was used in order to effect reverse-development for the photosensitive member of the positive charging property, in this embodiment. The prescription of the toner is as follows: 100 parts of styrene acrylic resin, 50 parts of magnetite, 10 parts of polypropylene resin (lubricant), and copy blue (electrification controlling material). They are kneaded, pulverized into particle size of 7 μm. Silica was used as an outer additives.

The images are produced through reverse-development using the above-described photosensitive member and toner.

The pre-rotation is carried out with Vdc=0 V applied to the developing sleeve. Then, the surface potential of the photosensitive member was +20 V=Voffset because of the offset potential. Thereafter, the developing sleeve was supplied with +300 V, and then the surface potential of the photosensitive member was Vdl=+315 V as a result of a some of +295 V=Vc provided by +300 V applied to the developing sleeve, and the offset potential. Accordingly, in the developing zone in the nip by the developer immediately downstream, the developing voltage is +300 V, and therefore, a reverse contrast is provided. The amount of fog in the non-image area after the image transfer was approx. 0.3%.

Figure 9:
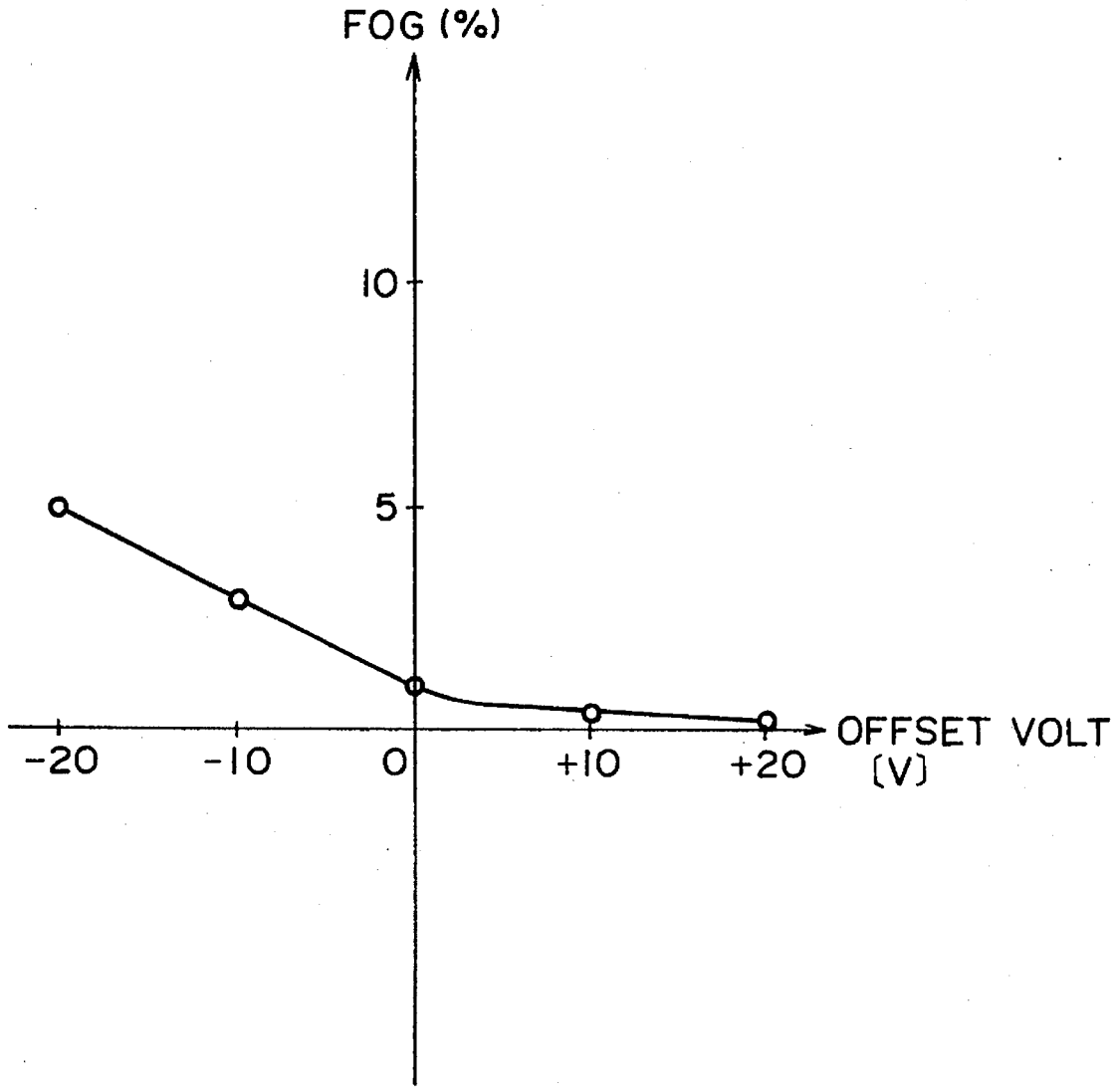
FIG. 9 shows a relation between an offset voltage and an amount of the fog.

The binder of the charge injection layer was replaced by acrylic resin material. In this case, the offset potential is −10 V, and therefore, the surface potential of the photosensitive member was +285 V with the result that the fog reflection ratio in the non-image area after the image transfer was as large as 3%, and therefore, the image quality was deteriorated. FIG. 9 illustrates interrelation between the offset potential and the fog, it has been confirmed that the fog preventing effect increases with increase of the positive offset potential, since then the proper reverse contrast can be provided.

Thus, by the provision of the charge injection layer on the surface of the photosensitive member for the simplified process, the selection for providing the offset potential of the same polarity and of the same magnitude can be made easier. By the improvement in the charge injection property, the image quality and the stability were improved.

In this embodiment, the order of lamination of the CTL and CGL are reversed as compared with the usual example to provide an OPC photosensitive member suitable for positive charging, and for this reason, the structure is such that the offset potential is positive. It is a possible alternative that the usual order of lamination is adopted, and a charge injection layer is provided on the surface thereof to provide a photosensitive member suitable for the negative charging. In this case, the offset potential has the negative polarity to suppress the fog.

EMBODIMENT 3

In this embodiment, in order to provide the offset potential, an additive is used for the developer.

As described hereinbefore, the fog background can be prevented by using as the reverse contrast the offset potential provided by rubbing between the material constituting the surface of the photosensitive member and the carrier and the toner constituting the developer. However, in the simplified process, the carrier is required to have 1. magnetic force for conveyance of the toner, 2. charge applying property for charging the toner, 3. electroconductivity for the uniform charging of the photosensitive member. To add thereon, the offset potential providing property tends to increase difficulty in the selection of the material.

As for the toner, tile charging property for assuring the proper triboelectric charge and proper insulating property for development in an electric field, are required, and therefore, imposing the property for providing the offset voltage may result in difficulty.

For this reason, in this embodiment, an additive for providing offset voltage is added to the developer (function separation), by which good images are produced with stability against ambient condition and long term use.

More particularly, a material having high charge application property is added to the inside or outside of the surface of The particles having a proper particle size, or the surface may be properly coated therewith, by which an additive can be produced. In order to prevent removal or scattering of the particles from the developer, the particles are preferably provided with magnetic property. However, the particles per se are electrically charged so that they are attracted electrostatically with the carrier or toner particles, and therefore, no unsatisfactory scattering does not necessarily result even if the magnetic property is not given.

The particle size of the additive may be any if the surface of the photosensitive member is stably charged and if the proper offset potential is provided. When, however, the electric resistance is high, and the particle size is extremely small as compared with the particle size of the carrier and the amount of additive is large, the magnetic carrier affects the electroconductive path by the chains formed under the magnetic field, with the result of increase of the resistance of the developer. If this occurs, the charging of the photosensitive member by the application of the voltage to the developing sleeve may be obstructed, and therefore, the particle size and the resistance of the additive is selected in consideration of this point.

In this embodiment, the apparatus had the same structure as in the second embodiment. The additive for providing the offset potential is produced by coating the surface of the carrier with tetrafluoroethylene resin material. By the tetrafluoroethylene coating, the volume resistivity of the carrier is increased from $10^4$ ohm–$10^9$ ohm. If a large amount, 5% by weight, for example, is added to the developer, the resistance of the developer is too high with the result of improper charging of the photosensitive member therefor, the amount of the additive was 2% by weight.

The offset potential when 0 V was applied to the developing sleeve, was measured as +40 V which is larger than +20 V as in the case of no additive. By this, the ambience dependence of the offset voltage was improved. The offset voltage reduced to +15 V by keeping it under high humidity condition from +20 V under the normal condition in the case of using no additive, is stabilized at +40 V irrespective of the ambient condition as a result of the use of the additive, and therefore, the fog in the background can be removed under all ambient conditions.

As alternatives, positive charge application property particles may be added to the outside of the surface of the carrier, or it may be added to the inside of the carrier resin, or the surface of the carrier is coated or plated with a metal having proper work function, by which additives capable of producing the offset voltage of proper property and magnitude.

As described in the foregoing, in an electrophotographic process in which a nip is formed by developer relative to the photosensitive member, and image information exposure, charging and developing operations are carried out in the nip, a sum of the offset potential generated by rubbing between the surface of the photosensitive member and the magnetic brush of the developer for effecting cleaning, charging and development, and a photosensitive member surface potential provided by the voltage applied to the magnetic brush, is made larger than an absolute value of a voltage applied to the magnetic brush. With this structure, a reverse contrast effective to suppress deposition of the toner from the magnetic brush to the non-image area, could be provided. Therefore, the fog in the background of the image which has been a problem in a conventional simplified process, can be improved.

While the invention has been described with reference to the structures disclosed herein, it is not confined to the details set forth and this application is intended to cover such modifications or changes as may come within the purposes of the improvements or the scope of the following claims.

What is claimed is:

1. An electrophotographic process in which an image exposing step and a developing step are carried out at the same position on opposite sides of a photosensitive member, comprising:

preparing an electrophotographic photosensitive member having a conductive base layer transmitting light and a photosensitive layer thereon;

exposing the conductive base side of the photosensitive member to light information;

rubbing an opposite side of said photosensitive member with a developer supplied with a developing bias voltage of the same polarity as the polarity of the developer in a region including an upstream side and a downstream side of an image exposure region of said photosensitive member;

wherein an absolute value of a sum of a triboelectric charge potential provided on a surface of said photosensitive member by rubbing between the developer and the photosensitive member and a surface potential of the photosensitive member provided by application of the developing bias upstream of the image exposure region, is larger than an absolute value of the developing bias of the image exposure region.

2. A process according to claim 1, wherein the developer comprises a toner, and an additive for inducing electric charge of the same polarity as the developing bias is added to the exterior surface of the toner.

3. A process according to claim 1, wherein the developer comprises a carrier, and an additive for inducing electric charge of the same polarity as the developing bias is added to the exterior surface of the carrier.

4. A process according to claim 1, wherein said developer comprises a carrier, and wherein a surface of the carrier is coated with a material for charging with the same polarity as the developing bias.

5. A process according to claim 1, wherein the developer comprises a toner and a carrier, and an additive for inducing electric charge of the same polarity as the developing bias is added to the exterior surface of the toner and the carrier.

6. A process according to claim 1, wherein said developer comprises insulative toner and magnetic carrier having a volume resistivity of $10^3$–$10^8$ ohm.cm, and said developer forms a magnetic brush in said developing step.

7. A process according to claim 1, wherein said photosensitive member comprises a photosensitive layer and a charge injection layer comprising insulative binder in which conductive particles are dispersed.

8. An electrophotographic process in which an image exposing step and a developing step are carried out at the same position on opposite sides of a photosensitive member, comprising:

preparing an electrophotographic photosensitive member having a conductive base layer transmitting light and an organic photosensitive layer thereon;

exposing the conductive base side of the photosensitive member to light information;

rubbing an opposite side of said photosensitive member with a developer supplied with a developing bias voltage of the same polarity as the polarity of the developer in a region including an upstream side and a downstream side of an image exposure region of said photosensitive member;

wherein an absolute value of a sum of a triboelectric charge potential provided on a surface of said photosensitive member by rubbing between the developer and the photosensitive member and a surface potential of the photosensitive member provided by application of the developing bias upstream of the image exposure region, is larger than an absolute value of the developing bias of the image exposure region.

9. A process according to claim 8, wherein the developer comprises a toner, and an additive for inducing electric charge of the same polarity as the developing bias is added to the exterior surface of the toner.

10. A process according to claim 8, wherein the developer comprises a carrier, and an additive for inducing electric charge of the same polarity as the developing bias is added to the exterior surface of the carrier.

11. A process according to claim 8, wherein said developer comprises a carrier, and wherein a surface of the carrier is coated with a material for charging with the same polarity as the developing bias.

12. A process according to claim 8, wherein the developer comprises a toner and a carrier, and an additive for inducing electric charge of the same polarity as the developing bias is added to outside the toner and the carrier.

13. A process according to claim 8, wherein said developer comprises insulative toner and magnetic carrier having a volume resistivity of $10^3$–$10^8$ ohm.cm, and said developer forms a magnetic brush in said developing step.

14. A process according to claim 8, wherein said photosensitive member comprises a photosensitive layer and a charge injection layer comprising insulative binder in which conductive particles are dispersed.

15. An electrophotographic apparatus in which an image exposing step and a developing step are carried out at the same position on opposite sides of a photosensitive member, comprising:

an electrophotographic photosensitive member having a conductive base layer transmitting light and a photosensitive layer thereon;

exposure means for exposing the conductive base side of the photosensitive member to light information;

developing means for effecting reverse development by rubbing an opposite side of said photosensitive member with a developer supplied with a developing bias voltage of the same polarity as the polarity of the developer in a region including an upstream side and a downstream side of an image exposure region of said photosensitive member;

wherein an absolute value of a sum of a triboelectric charge potential provided on a surface of said photosensitive member by rubbing between the developer and the photosensitive member and a surface potential of the photosensitive member provided by application of the developing bias upstream of the image exposure region, is larger than an absolute value of the developing bias of the image exposure region.

16. An apparatus according to claim 15, wherein said photosensitive member is movable along an endless path with the photosensitive layer outside, and wherein said exposure means is inside said photosensitive member, and said developing means is outside thereof.

17. An apparatus according to claim 15, wherein said developer comprises insulative toner and magnetic carrier having a volume resistivity of $10^3$–$10^8$ ohm.cm, and said developer forms a magnetic brush in said developing step.

18. An electrophotographic apparatus in which an image exposing step and a developing step are carried out at the same position on opposite sides of a photosensitive member, comprising:

an electrophotographic photosensitive member having a conductive base layer transmitting light and an organic photosensitive layer thereon;

exposure means for exposing the conductive base side of the photosensitive member to light information;

developing means for effecting reverse development by rubbing an opposite side of said photosensitive member with a developer supplied with a developing bias voltage of the same polarity as the polarity of the developer in a region including an upstream side and a downstream side of an image exposure region of said photosensitive member;

wherein an absolute value of a sum of a triboelectric charge potential provided on a surface of said photosensitive member by rubbing between the developer and the photosensitive member and a surface potential of the photosensitive member provided by application of the developing bias upstream of the image exposure region, is larger than an absolute value of the developing bias of the image exposure region.

19. An apparatus according to claim 18, wherein said photosensitive member comprises a photosensitive layer and a charge injection layer comprising insulative binder in which conductive particles are dispersed.

20. An apparatus according to claim 18, wherein said developer comprises insulative toner and magnetic carrier having a volume resistivity of $10^3$–$10^8$ ohm.cm, and said developer forms a magnetic brush in said developing step.

* * * * *

UNITED STATES PATENT AND TRADEMARK OFFICE

CERTIFICATE OF CORRECTION

PATENT NO. : 5,567,556

DATED : October 22, 1996

INVENTOR(S) : Yano et al.

It is certified that error appears in the above-identified patent and that said Letters Patent is hereby corrected as shown below:

On the title page, item

AT [54] IN THE TITLE

"OPPOSITES" should read --OPPOSITE--.

AT [57] IN THE ABSTRACT

Line 11, "end" should read --and--.

COLUMN 1

Line 4, "OPPOSITES" should read --OPPOSITE--.
Line 19, "Onto" should read --onto--.
Line 36, "The" should read --the--.

COLUMN 2

Line 3, "in-the" should read --in the --.

COLUMN 4

Line 3, "member I" should --member 1--.
Line 41, "%he" should read --the--.

COLUMN 5

Line 12, "as" should read --has--.
Line 60, "is" should be deleted.
Line 62, "oven" should read --even--.

UNITED STATES PATENT AND TRADEMARK OFFICE

CERTIFICATE OF CORRECTION

PATENT NO. : 5,567,556

DATED : October 22, 1996

INVENTOR(S) : Yano et al.

It is certified that error appears in the above-identified patent and that said Letters Patent is hereby corrected as shown below:

COLUMN 6

Line 10, "properly," should read --property,--.
Line 21, "tile" should read --the--.

COLUMN 9

Line 35, "charging.," should read --charging,--.
Line 42, "given" should read --given in--.
Line 65, "property, in this" should read --property.--.
Line 66, "embodiment." should be deleted.

COLUMN 10

Line 2, "kneaded," should read --kneaded and--.
Line 4, "additives." should read --additive.--
Line 13, "some" should read --sum--.
Line 26, "fog, it" should read --fog. It--.
Line 57, "applying" should read --inducing--.
Line 63, "tile" should read --the--.

COLUMN 11

Line 5, "applica-" should read --inducing--.
Line 6, "tion" should be deleted.
Line 7, "The" should read --the--.
Line 13, "no" should be deleted.
Line 49, "application" should read --inducing--.

UNITED STATES PATENT AND TRADEMARK OFFICE

CERTIFICATE OF CORRECTION

PATENT NO. : 5,567,556

DATED : October 22, 1996

INVENTOR(S) : Yano et al.

It is certified that error appears in the above-identified patent and that said Letters Patent is hereby corrected as shown below:

COLUMN 12

Line 19, "information;" should read --information; and--.
Line 67, "information;" should read --information; and--.

COLUMN 13

Line 30, "outside" should read --the exterior surface of--.
Line 47, "information;" should read --information; and--.

UNITED STATES PATENT AND TRADEMARK OFFICE

CERTIFICATE OF CORRECTION

PATENT NO. : 5,567,556

DATED : October 22, 1996

INVENTOR(S) : Yano et al.

It is certified that error appears in the above-identified patent and that said Letters Patent is hereby corrected as shown below:

COLUMN 14

Line 27, "information; should read --information; and--.

Signed and Sealed this

First Day of April, 1997

Bruce Lehman

*Attest:*

BRUCE LEHMAN

*Attesting Officer*

*Commissioner of Patents and Trademarks*